US008723774B2

(12) United States Patent
Park et al.

(10) Patent No.: US 8,723,774 B2
(45) Date of Patent: May 13, 2014

(54) LIQUID CRYSTAL DISPLAY APPARATUS, LIQUID CRYSTAL DRIVING APPARATUS, AND METHOD FOR DRIVING LIQUID CRYSTAL DISPLAY APPARATUS

(75) Inventors: Ji-yong Park, Suwon-si (KR); Sang-kyun Im, Seoul (KR); Nam-kyun Beon, Seoul (KR); Yu Li, Suwon-si (KR); Hye-rin Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 612 days.

(21) Appl. No.: 12/728,625

(22) Filed: Mar. 22, 2010

(65) Prior Publication Data

US 2011/0007098 A1 Jan. 13, 2011

(30) Foreign Application Priority Data

Jul. 9, 2009 (KR) ..... 10-2009-0062618

(51) Int. Cl.
*G09G 3/36* (2006.01)

(52) U.S. Cl.
USPC ..... 345/89; 345/96

(58) Field of Classification Search
USPC ..... 345/89, 96
See application file for complete search history.

(56) References Cited

U.S. PATENT DOCUMENTS

| | | | | |
|---|---|---|---|---|
| 2006/0164361 | A1 | 7/2006 | Yi | |
| 2008/0079852 | A1 | 4/2008 | Nagaishi et al. | |
| 2008/0179677 | A1 | 7/2008 | Murata et al. | |
| 2008/0180369 | A1 | 7/2008 | Chiu et al. | |
| 2008/0204444 | A1 | 8/2008 | Rye et al. | |
| 2008/0238897 | A1 | 10/2008 | Kimura | |
| 2008/0266225 | A1* | 10/2008 | Kim | 345/88 |
| 2008/0297457 | A1 | 12/2008 | Song et al. | |

FOREIGN PATENT DOCUMENTS

| | | | |
|---|---|---|---|
| EP | 2276017 | A1 | 1/2011 |
| JP | 200510579 | A | 1/2005 |

OTHER PUBLICATIONS

Extended European Search Report issued Jul. 5, 2010 in counterpart European Patent Application No. 10158531.3.
Communication dated Aug. 3, 2012 from the European Patent Office in counterpart European Application No. 10157764.1.
Communication dated Jul. 4, 2011 from the European Patent Office in counterpart European Patent Application No. 10157764.1.

* cited by examiner

*Primary Examiner* — Jonathan Boyd
(74) *Attorney, Agent, or Firm* — Sughrue Mion, PLLC

(57) ABSTRACT

A liquid crystal display (LCD) apparatus, an LCD driving apparatus, and a method for driving the LCD apparatus are provided. The LCD apparatus includes a panel; and a controlling unit which inserts gray data into at least one pixel included in a pixel group. Accordingly, the stress on a liquid crystal is reduced and thus a residual image is prevented from occurring on a screen.

13 Claims, 11 Drawing Sheets

LIQUID CRYSTAL DISPLAY APPARATUS, LIQUID CRYSTAL DRIVING APPARATUS, AND METHOD FOR DRIVING LIQUID CRYSTAL DISPLAY APPARATUS

CROSS-REFERENCE TO RELATED APPLICATIONS

This application claims priority from Korean Patent Application No. 10-2009-0062618, filed on Jul. 9, 2009 in the Korean Intellectual Property Office, the disclosure of which is incorporated herein by reference in its entirety.

BACKGROUND

1. Field

Apparatuses and methods consistent with the exemplary embodiments relate to a liquid crystal display (LCD) apparatus, an LCD driving apparatus, and a method for driving the LCD apparatus, and more particularly, to resolving problems regarding a residual image displayed on a screen.

2. Description of the Related Art

Recently, televisions (TVs) have become larger, and thus users can watch images on a larger screen. The large-screen TVs have been rapidly developed with the development of thin film transistor liquid crystal displays (TFT LCDs) and plasma display panels (PDP). The large-screen TVs are used to broadcast, among other things, advertisements which are produced using various contents and active motion images, which can be effective for advertising products. The display apparatus having the above purpose is referred to as a digital information display (DID).

However, when the DID is used for the purpose of commercial advertisement, the DID is driven for a long time and displays the same images on a screen for a long time period, unlike the display apparatus which is used for the purpose of broadcasting. Accordingly, an image sticking phenomenon may occur, in which a liquid crystal is stressed, and thus it is difficult to convert an image into another image.

Therefore, there is a need for methods to allow a user to conveniently watch an image by reducing the stress on a liquid crystal and preventing a residual image from occurring on a DID screen.

SUMMARY

Exemplary embodiments address at least the above problems and/or disadvantages and other disadvantages not described above. Also, the exemplary embodiments are not required to overcome the disadvantages described above, and an exemplary embodiment may not overcome any of the problems described above.

One or more exemplary embodiments provide an LCD apparatus, an LCD driving apparatus, and a method for driving an LCD apparatus in order to effectively remove a residual image from a screen.

According to an aspect of an exemplary embodiment, there is provided a liquid crystal display an LCD apparatus, including a panel unit which includes at least one pixel group comprising a plurality of pixels; and a controlling unit which inserts gray data into a part of pixels included in each pixel group in consideration of a frame period and polarity of the plurality of pixels.

The controlling unit may insert the gray data into pixels included in each pixel group in a predetermined pattern for a predetermined frame period.

The predetermined pattern may be a pattern which causes the gray data to be inserted into one of the pixels included in the each pixel group for a single frame.

The predetermined pattern may be a pattern which causes the gray data to be inserted into the pixels included in the each pixel group at least one time for the predetermined frame period.

There may be a plurality of predetermined patterns, and the controlling unit may select one of the plurality of predetermined patterns for each pixel group, respectively, and insert the gray data according to the selected pattern.

The predetermined pattern may include a plurality of sub patterns, and the controlling unit may change the sub patterns every frame period corresponding to the number of pixels included in each pixel group.

The changed sub pattern may be partially the same as the previous sub pattern, and the controlling unit may insert the gray data from the pixel, to which gray data are secondarily inserted in the previous sub pattern, in the changed sub pattern, and lastly insert gray data into the pixel, to which gray data are firstly inserted in the previous sub pattern.

If the pixel group is formed in N*N pixels, the controlling unit may insert the gray data into each pixel every $(N^2-1)_{th}$ frame or $(N^2+1)_{th}$ frame.

The controlling unit may decide a time point at which new gray data are inserted into the pixel into which the previous gray data are inserted so that the number of positive polarity of the pixel is identical to the number of negative polarity of the pixel before the new gray data are inserted into the pixel to which the previous gray data are inserted.

The LCD apparatus may further include an input unit which receives Red, Green, Blue (RGB) data, wherein the controlling unit may generate gray data mask based on information regarding pixels into which the gray data are inserted in a current frame from among the plurality of pixels, and mask the RGB data by the gray data mask.

The LCD apparatus may further include a driving unit which generates gray data voltage or normal data voltage, and insert the data into the plurality of pixel, wherein the controlling unit may control the driving unit based on the RGB data masked by the gray data mask to apply the gray data voltage or the normal data voltage to each pixel.

According to an aspect of another exemplary embodiment, there is provided a liquid crystal driving apparatus, including a gate driving unit which applies gate-on voltage to a plurality of pixels; and a data driving unit which applies gray data voltage to a part of the plurality of pixels in consideration of patterns of a frame period and polarity of the pixels.

According to an aspect of another exemplary embodiment, there is provided a method for driving an LCD apparatus, including applying gray data voltage to a part of pixels included in each pixel group, and normal data voltage to the other pixels in consideration of a frame period and polarity of the pixels; and displaying an image based on the gray data voltage and the normal data voltage.

The method may apply the gray data voltage to the pixels included in each pixel group in a predetermined pattern.

The predetermined pattern may be a pattern which causes the gray data to be inserted into one of the pixels included in the each pixel group for a single frame.

The predetermined pattern may be a pattern which causes the gray data to be inserted into the pixels included in the each pixel group at least one time for the predetermined frame period.

There may be a plurality of predetermined patterns, and one of the plurality of predetermined patterns may be selected for each pixel group, respectively, and the gray data voltage may be applied according to the selected pattern.

The predetermined pattern may include a plurality of sub patterns, the sub patterns may change every frame period corresponding to the number of pixels included in each pixel group, and the gray data voltage may be applied.

The changed sub pattern may be partially the same as the previous sub pattern, and the gray data voltage from the pixel, into which gray data are secondarily inserted, may be applied to the previous sub pattern, in the changed sub pattern, and lastly apply the gray data voltage to the pixel to which gray data voltage are firstly applied in the previous sub pattern.

The gray data voltage may be applied to each pixel every $(N^2-1)_{th}$ frame or $(N^2+1)_{th}$ frame if the pixel group is formed in N*N pixels.

The method may decide a time point at which new gray data voltage is applied to the pixel to which the previous gray data voltage is applied so that the number of positive polarity of the pixel is identical to the number of negative polarity of the pixel before the new gray data voltage is applied to the pixel to which the previous gray data voltage is applied.

The method for driving an LCD apparatus may further include receiving RGB data, generating a gray data mask based on information regarding pixels to which the gray data voltage is applied in a current frame among the plurality of pixels; and masking the RGB data by the gray data mask, wherein the applying may apply the gray data voltage to a part of pixels included in each pixel group, and apply the normal data voltage to the other pixels based on the masked RGB data.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
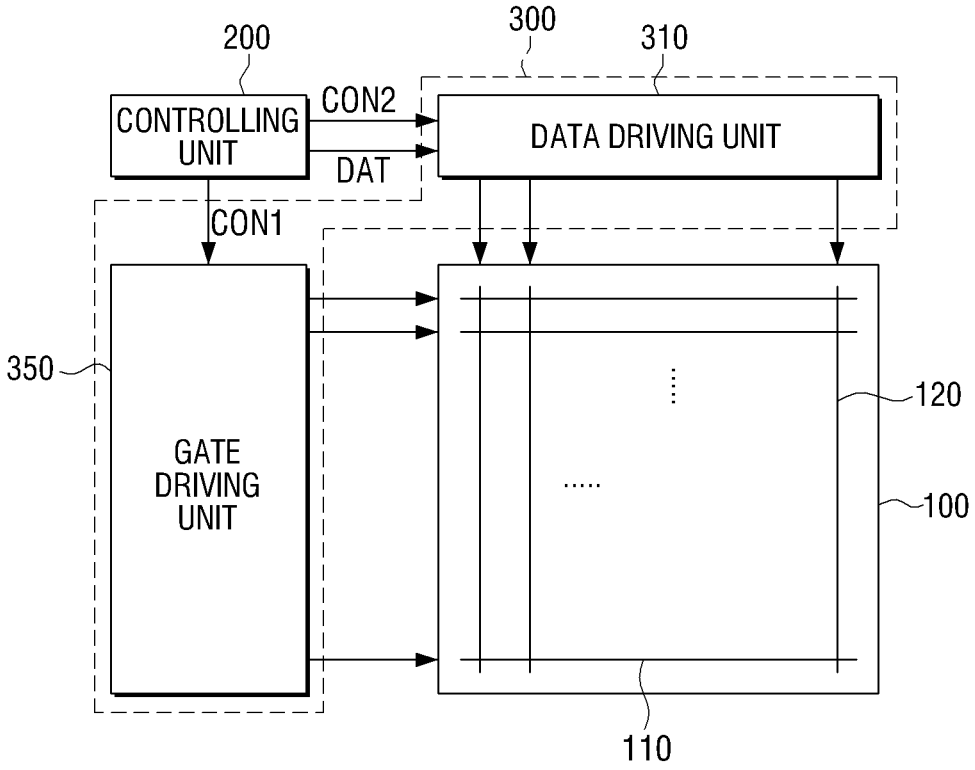
FIG. 1 is a view illustrating an LCD apparatus applicable to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a view illustrating an LCD apparatus applicable to an exemplary embodiment. The LCD apparatus, according to the exemplary embodiment, receives an image frame, masks the received image frame by gray data, and displays a screen of the masked image frame.

Referring to FIG. 1, the LCD apparatus includes a panel unit 100, a controlling unit 200, and a driving unit 300.

The panel unit 100 includes a plurality of gate lines 110, a plurality of data lines 120, and a plurality of pixels which are formed on cross areas of the gate lines and the data lines.

The data line receives data voltage which is generated by converting grayscale data into voltage from a data driving unit 310 to be described later, and applies data voltage to a pixel. Herein, the grayscale data refer to data that expresses black gradation, white gradation, and intermediate gradation between the black and white gradation by adjusting liquid crystal transmittance.

The gate line 110 receives gate-on voltage from a gate driving unit 350 to be described later, and applies the gate-on voltage to a pixel.

The pixel is formed on a cross area of a gate line 110, which applies a gate-on voltage, and a data line 120, which applies a data voltage corresponding to the grayscale data.

Figure 2:
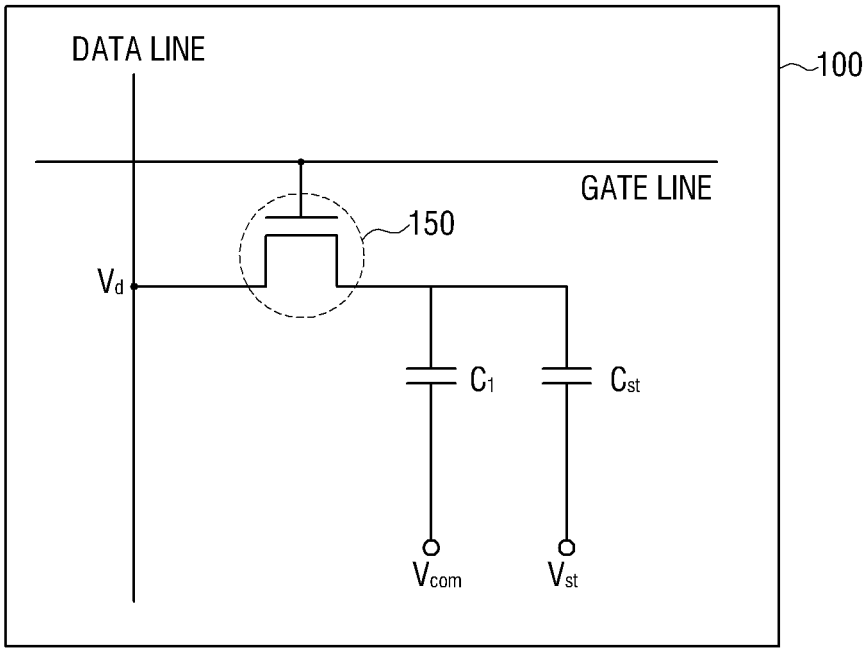
FIG. 2 is a view illustrating a single pixel among a plurality of pixels according to an exemplary embodiment.

The detailed description regarding a pixel will be provided with reference to FIG. 2. FIG. 2 is a view illustrating a single pixel among a plurality of pixels according to an exemplary embodiment.

A pixel comprises a thin film transistor 150 of which the source electrode and the gate electrode are connected to a data line and a gate line, respectively, and a liquid capacitor C1 and a storage capacitor Cst which are connected to the drain electrode of the thin film transistor 150.

If a gate-on voltage is applied to a gate line and thus the thin film transistor 150 is turned on, data voltage Vd which is supplied to the data line is applied to an electrode (not shown) of each pixel through the thin film transistor 150. An electric field corresponding to the difference between the pixel voltage and common voltage Vcom is applied to a liquid crystal, and light is transmitted at transmittance corresponding to the magnitude of the electric field.

The pixel causes the gate-on voltage applied to the gate line and the data voltage applied to the data line to display a desired image.

As described above, the LCD apparatus generates an electric field on a liquid crystal by applying data voltage and gate voltage to a pixel, adjusts the transmittance of light which penetrates the liquid crystal by adjusting the magnitude of electric field, and obtains a desired image.

Referring to again FIG. 1, the controlling unit 200 receives an image signal from an external source, and performs data processing and image processing on the image signal. Specifically, the controlling unit 200 receives RGB data, a data enable signal which represents a start time point of a frame, a synchronization signal, and a clock signal, and performs data processing such as timing redistribution using the received signals. The controlling unit 200 performs image processing so that the RGB data is masked by gray data, which reduces stress on the liquid crystal, and thus prevents a residual image from occurring on a screen.

The controlling unit 200 transmits a control signal CON1 to the gate driving unit 350, and a control signal CON2 and grayscale data DAT of an image frame to the data driving unit 310 so that the panel unit 100 is driven. Specifically, the controlling unit 200 transmits grayscale data which are masked by gray data to the data driving unit 310.

The driving unit 300 drives the panel unit 100 using the grayscale data DAT which are masked by the gray data being output from the controlling unit 200. The driving unit 300 includes the data driving unit 310 and the gate driving unit 350.

The data driving unit 310 changes the masked grayscale data DAT being received from the controlling unit 200 to data voltage, and applies the data voltage to each data line.

The gate driving unit 350 sequentially applies a gate-on voltage to each of the gate lines, and turns on the thin film transistor 150 having its gate electrode connected to a gate line to which the gate-on voltage is applied.

Accordingly, the LCD apparatus according to the exemplary embodiment reduces stress on a liquid crystal, and thus prevents a residual image from occurring on a screen by using the grayscale data masked by gray data.

Figure 3:
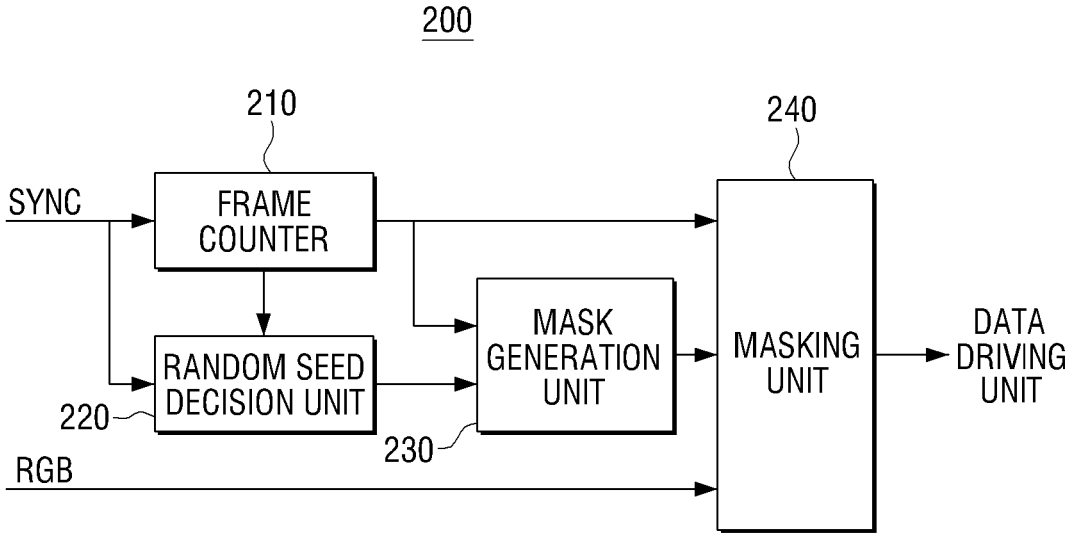
FIG. 3 is a block diagram illustrating a controlling unit according to an exemplary embodiment.

FIG. 3 is a block diagram illustrating the controlling unit 200 according to an exemplary embodiment. Referring to FIG. 3, the controlling unit 200 comprises a frame counter 210, a random seed decision unit 220, a mask generation unit 230, and a masking unit 240.

The frame counter 210 receives a synchronization signal SYNC, counts the received synchronization signal to recognize a frame period (frame number). The frame counter 210 transfers information regarding the recognized frame to the random seed decision unit 220, the mask generation unit 230, and the masking unit 240.

The random seed decision unit 220 divides a plurality of pixels formed on the panel unit 100 into a plurality of pixel groups, decides a pattern in consideration of a frame period and the polarity of pixels included in each pixel group so that gray data are inserted into the pixels included in each pixel group.

The reason for deciding a pattern to insert gray data will be explained before describing a method for deciding a pattern to insert gray data.

The LCD apparatus according to the exemplary embodiment is driven in an inversion driving method, in which the polarity of a liquid crystal is reversed in a frame period unit, a row unit, or a pixel unit in order to reduce a direct current (DC) offset component and to prevent depletion of a liquid crystal. The inversion driving method which causes the voltage of polarity of the liquid crystal to be reversed is illustrated in FIGS. 4A to 4C.

Figure 4A:
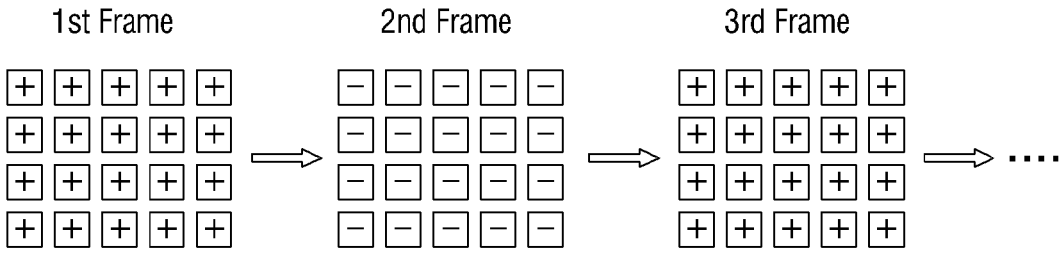
FIGS. 4A to 4C are views provided to explain an inversion driving method among methods to drive an LCD apparatus.
Figure 4B:
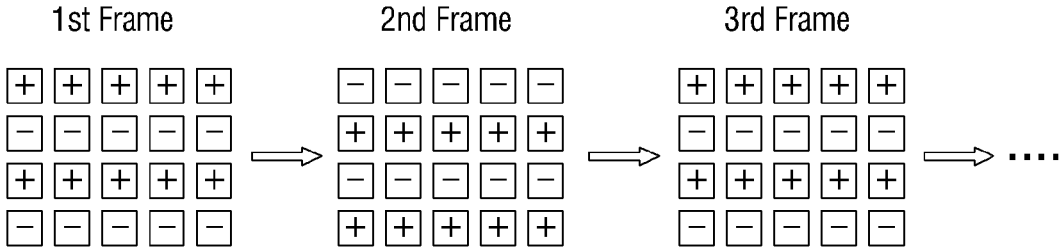
Figure 4C:
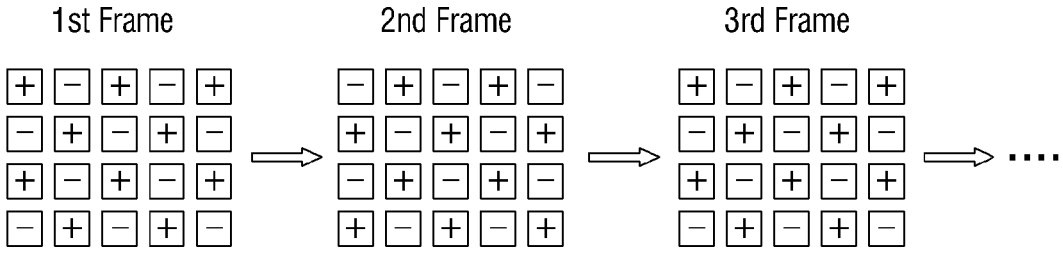

FIGS. 4A to 4C are views provided to explain an inversion driving method among methods to drive an LCD apparatus.

The LCD apparatus according to the exemplary embodiment applies data voltage and gate voltage to a pixel to generate an electric field on a liquid crystal, adjusts the magnitude of the pixel electrode by adjusting the transmittance of light penetrating the liquid crystal in order to obtain a desired image. The LCD apparatus then reverses the polarity of the data voltage with respect to the gate voltage in a frame period unit, as shown in FIGS. 4A to 4C, in order to prevent depletion which is caused on a liquid crystal when the same polarity is applied for a long time.

FIG. 4A illustrates that the polarity of data voltage is reversed with respect to gate voltage in a frame unit. FIG. 4B illustrates that the polarity of data voltage is reversed with respect to gate voltage in a frame unit, and polarity of adjacent rows is also reversed so the rows have alternating polarity. FIG. 4C illustrates that the polarity of data voltage is reversed in a frame unit, and polarity of adjacent pixels is also reversed so the pixels have alternating polarity.

The LCD apparatus according to the exemplary embodiment may prevent depletion of a screen using the above inversion driving method.

However, if only one polarity is supplied for a long time, or two polarities occur alternately the liquid crystal may be stressed, and a residual image may appear on a screen. The residual image is referred to as "a direct current (DC) image sticking" since the voltage having only one polarity is repeatedly charged to a liquid crystal cell.

In order to prevent the DC image sticking, the LCD apparatus according to the exemplary embodiment temporarily generates gray data instead of grayscale data corresponding to RGB data to be practically displayed on a screen according to a predetermined pattern. The LCD apparatus, according to the exemplary embodiment, inserts gray data according to a predetermined pattern in consideration of a frame period and polarity. Therefore, the depletion of a screen is prevented, and stress is reduced from a liquid crystal one polarity which is stronger than another polarity is not supplied for a long time.

Referring to again FIG. 3, the random seed decision unit 220 decides a pattern to insert gray data into pixels on the panel unit 100.

In order to decide a pattern, the random seed decision unit 220 divides a plurality of pixels formed on the panel unit 100 into a plurality of pixel groups, and decides a random seed to be applied to each pixel group. The random seed refers to the rule of inserting gray data into each pixel group. The detailed description of a random seed will be provided with reference to FIG. 5.

Figure 5:
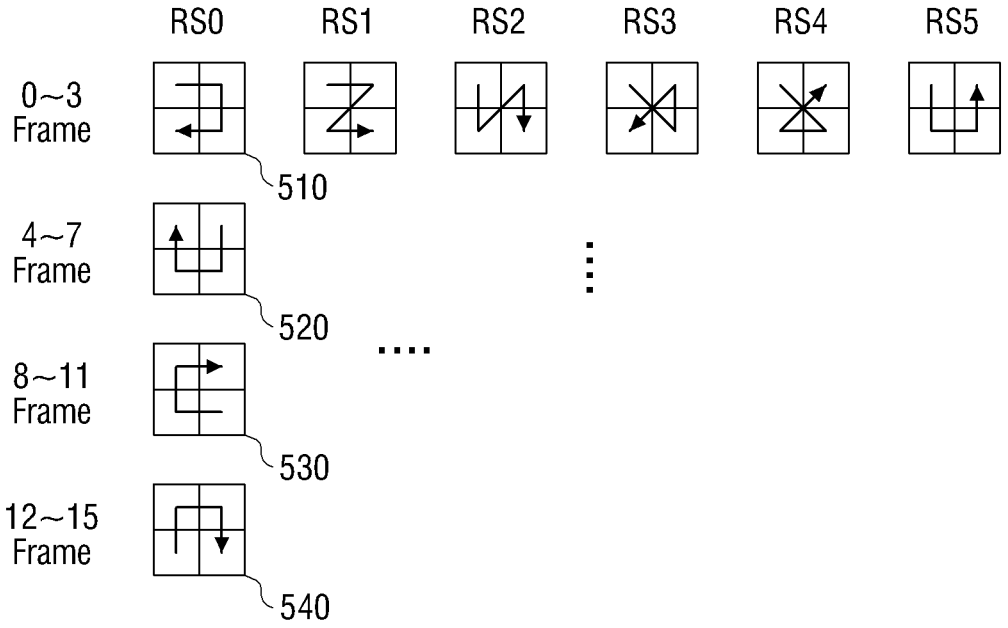
FIG. 5 is a view illustrating the process of determining a pattern according to a random seed.

FIG. 5 is a view illustrating the process of deciding a pattern according to a random seed. In pixel group (N*N), the total number of random seeds may be calculated as follows:

$$\frac{N!}{N} = (N-1)! \qquad \text{[Equation 1]}$$

If a pixel group (2*2) is composed of four pixels, six kinds of random seeds from random seed 0 (RS 0) to random seed (RS 5) may be formed in the pixel group.

The number of kinds of random seeds is the maximum number of possible random seeds, and it is not necessary for all of the random seeds complying with Equation 1 to be used.

If one of random seeds from RS 0 to RS 5 is assigned to each pixel group, respectively, gray data are inserted into respective pixels included in each pixel group according to the assigned random seeds while considering the frame period.

A random seed is composed of a single main pattern, and the single main pattern is composed of a plurality of sub patterns. For example, in the case of RS 0 of FIG. 5, gray data are inserted into pixels from frame 0 to frame 3 according to a sub pattern 510, and gray data are inserted into pixels from frame 4 to frame 7 according to a sub pattern 520.

Accordingly, gray data are inserted into an upper-left pixel in frame 0, gray data are inserted into an upper-right pixel in frame 1, gray data are inserted into a lower-right pixel in frame 2, and gray data are inserted into a lower-left pixel in frame 3. Identically, gray data are inserted into an upper-right pixel in frame 4, gray data are inserted into a lower-right pixel in frame 5, gray data are inserted into a lower-left pixel in frame 6, and gray data are inserted into an upper-left pixel in frame 7.

As described above, gray data are inserted into each pixel, according to the sub pattern 510 from frame 0 to frame 3, the sub pattern 520 from frame 4 to frame 7, a sub pattern 530 from frame 8 to frame 11, and a sub pattern 540 from frame 12 to frame 15.

In addition, gray data are inserted into each pixel as sub patterns 510, 520, 530, and 540 are applied repeatedly after frame 15.

The order of the above sub patterns may be a kind of a main pattern. Therefore, it is not necessary to apply the sub pattern 520 after the sub pattern 510, and the order of sub patterns may be set by a user or according to a preset main pattern. That is, the sub pattern 530 may be applied after the sub pattern 510, and the sub pattern 540 may be applied after the sub pattern 520.

The total number of kinds of sub patterns in a N*N pixel group is calculated as follows:

$$N*N \quad \text{[Equation 2]}$$

If a random seed is added to a specific pixel group, gray data are inserted into the pixel group having the random seed according to a main pattern in a broad sense, and gray data are inserted into the pixel group according to a plurality of sub patterns in a narrow sense.

The number of kinds of sub patterns calculated by Equation 2 is the maximum number, and it is not necessary to use all of the sub patterns.

The plurality of sub patterns are applied differently according to the frame period. Gray data are inserted into the pixel group having RS 0 according to a main pattern in which gray data are inserted in the clockwise direction, and gray data are inserted into each pixel from frame 0 to frame 3 according to a sub pattern in which gray data are inserted starting with an upper-left pixel. Gray data are inserted into each pixel from frame 4 to frame 7 according to a sub pattern in which gray data are lastly inserted into the pixel to which gray data are firstly inserted within a previous frame, and gray data are firstly inserted into the pixel to which gray data are secondarily inserted within a previous frame. In other words, the sub pattern 520 is rotated by one pixel in the clockwise direction relative to the sub pattern 510.

The above main pattern and the sub patterns are applied differently for each pixel group. Accordingly, it is not necessary that all of the pixels formed on the panel unit 100 have the same main pattern or sub pattern, and gray data are inserted into pixels according to a main pattern or a sub pattern for each pixel group.

For example, gray data may be inserted into the pixel group formed on a specific portion of the panel unit 100 according to RS 2, and gray data may be inserted into the pixel group formed on a different portion of the panel unit 100 according to RS 3.

It is not necessary for the above main pattern and sub pattern to be applied to all of the pixel groups formed on the panel unit 100, and the patterns may be applied to the pixel group formed on a portion in which an image does not vary.

The reason for deciding a time point at which gray data are inserted into each pixel using a sub pattern relates to preventing the DC image sticking from occurring. To do so, a main pattern and sub patterns are generated in consideration of polarity. Herein, the DC image sticking represents the phenomenon that only one of negative and positive polarity is supplied for a long time or negative polarity and positive polarity are alternately supplied, and thus the liquid crystal is stressed.

Figure 6:
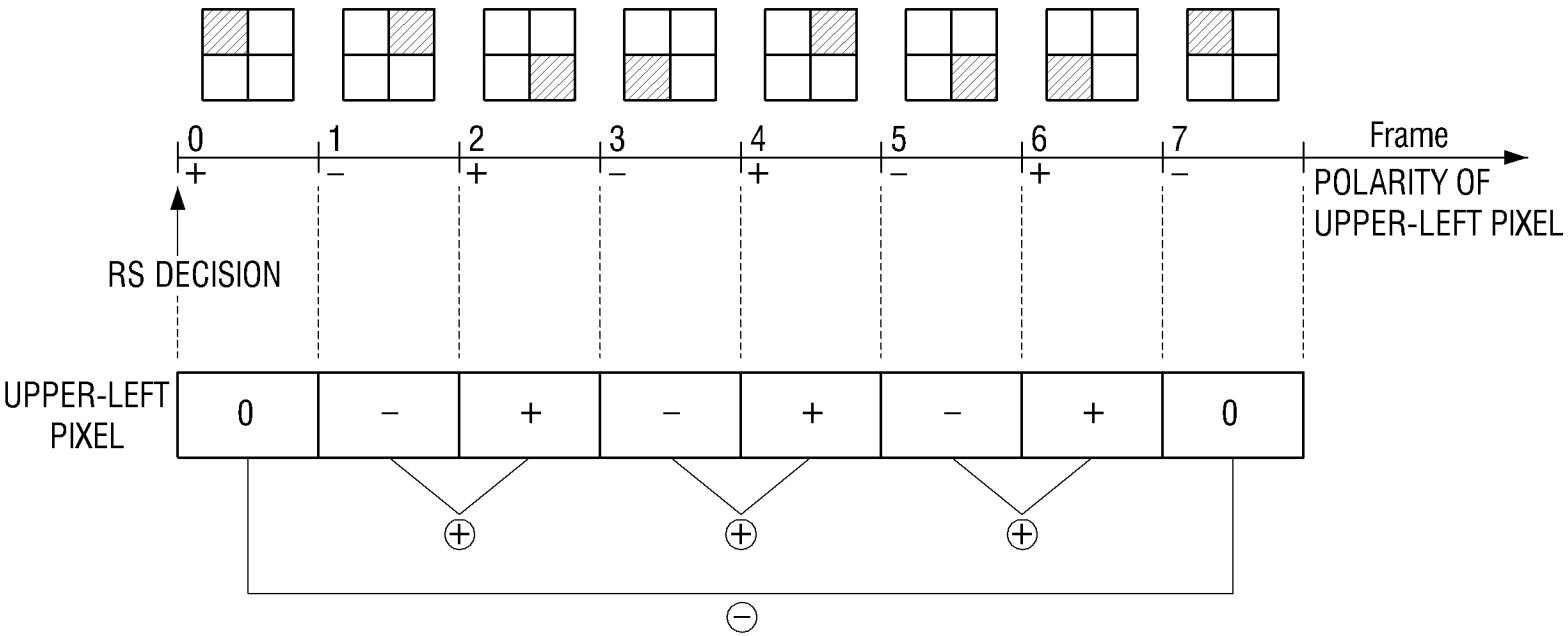
FIG. 6 is a view provided to explain the polarity of pixels.

The detailed description of pixel polarity will be provided with reference to FIG. 6.

In FIG. 6, RS 0 is applied to the pixel group illustrated in FIG. 5, and gray data are inserted into pixels for convenience of description. Accordingly, gray data are inserted into pixels from frame 0 to frame 7 in order of an upper-left pixel, an upper-right pixel, a lower-right pixel, a lower-left pixel, an upper-right pixel, a lower-right pixel, a lower-left pixel, and an upper-left pixel.

As the LCD apparatus, according to the exemplary embodiment, uses an inversion driving method, the liquid crystal polarity +, −, +, −, +, −, +, −, is formed on the upper-left pixel from frame 0 to frame 7. Of course, the polarity is formed on not only the upper-left pixel but also the other pixels in an alternate order of positive polarity and negative polarity. Accordingly, the DC component becomes 0.

In this situation, the positive polarity is superior by the combination of positive polarity in frame 0 and negative polarity in frame 1, the positive polarity is superior by the combination of positive polarity in frame 2 and negative polarity in frame 3, the positive polarity is superior by the combination of positive polarity in frame 4 and negative polarity in frame 5, and the positive polarity is superior by the combination of positive polarity in frame 6 and negative polarity in frame 7. The superiority of positive polarity is not limited to frames 0 to 7, and the positive polarity may be superior in frames after frames 0 to 7.

As the positive polarity is superiorly supplied for a long time, the liquid crystal is stressed and thus the DC image sticking may occur.

To reduce the stress on the liquid crystal, the LCD apparatus, according to the exemplary embodiment, intermittently inserts gray data. Accordingly, the LCD apparatus weakens the positive polarity which is formed by the combination of the polarity of frames not having gray data by increasing the negative polarity which is formed by the combination of the polarity of frames having gray data. By doing so, the LCD apparatus may not cause the positive polarity to be supplied for a long time.

The above described experiment is illustrated in a lower portion of FIG. 6. As shown in FIG. 6, gray data are inserted into the upper left pixel in frame 0 and frame 7 and thus the positive polarity is superior by the combination of the negative polarity in frame 1 and the positive polarity in frame 2, the positive polarity is superior by the combination of the negative polarity in frame 3 and the positive polarity in frame 4, and the positive polarity is superior by the combination of the negative polarity in frame 5 and the positive polarity in frame 6. However, as the negative polarity is superior by the combination of polarity in frames 0 and 7, the entire positive polarity is lowered.

That is, the positive polarity from frame 1 to frame 6 may be alleviated by increasing the negative polarity which is formed by the combination of polarity in frames 0 and 7 having gray data. In addition, the positive polarity is prevented from being superior for a long time.

By doing so, the stress on a liquid crystal may be reduced, and the residual image may be prevented from occurring on a screen.

If a N*N pixel group is formed, frame period F during which gray data are inserted is calculated as follows:

$$F=(N*N-1)\text{or}(N*N+1) \quad \text{[Equation 3]}$$

As the liquid crystal may have positive polarity and negative polarity alternately, the DC component may become 0. As gray data are inserted by applying Equation 3, it may be prevented that positive polarity is applied for a long time.

The exemplary embodiment of forming 2*2 pixel group is described above, but this is merely an exemplary embodiment for convenience of description. Accordingly, the pixel group may be formed as a larger group, and the pixel group is not limited to a square matrix. The pixel group may be formed as a rectangular matrix, and the pixels formed on the panel unit 100 may be grouped in a different form.

In addition, when a pattern is applied, related art patterns such as a modified bayer pattern having efficient dithering may also be applied.

Referring to again FIG. 3, the random seed decision unit 220 decides a pattern in consideration of a frame period and polarity of pixels included in each pixel group so that gray data are inserted into the pixels included in each pixel group, and transfers the information regarding the random seed for each pixel group to the mask generation unit 230.

The mask generation unit 230 receives information regarding a frame period which is recognized by the frame counter 210 and information regarding a random seed for each pixel group from the random seed decision unit 220.

The mask generation unit 230 generates a mask for each frame using the information regarding a frame period and the information regarding a random seed. The mask is used to convert grayscale data of an image frame to be originally output into grayscale data which are masked by gray data, and is generated for each frame by the mask generation unit 230.

Figure 7:
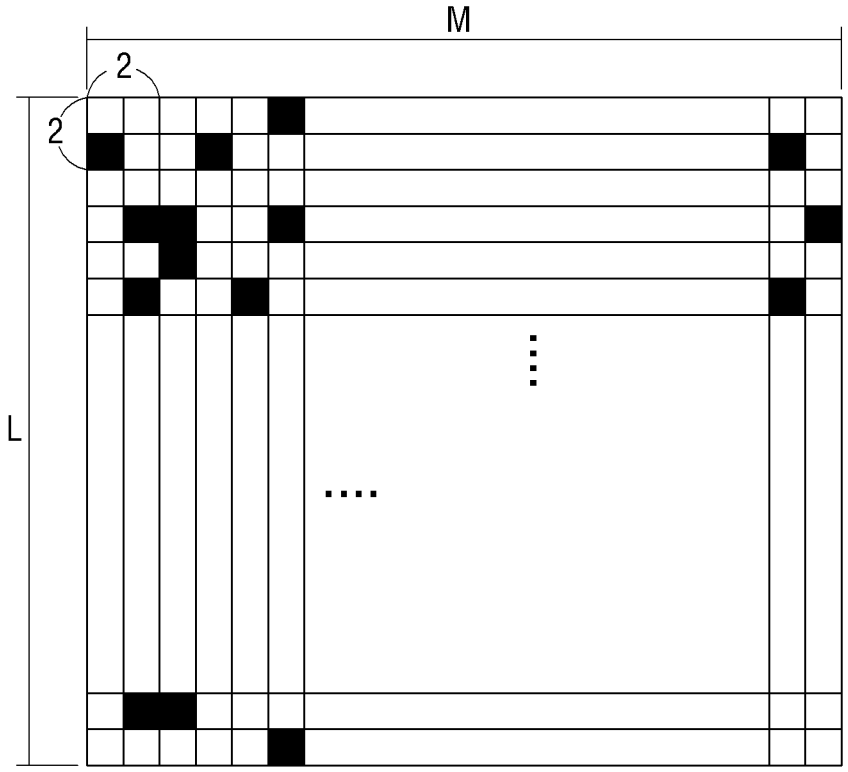
FIG. 7 is a view illustrating a mask according to an exemplary embodiment.

The description regarding a mask will be provided with reference to FIG. 7.

Referring to FIG. 7, when the number of overall pixels formed on the panel unit 100 is M*L pixels, and each pixel group is formed in 2*2, the random seed decision unit 220 decides a main pattern and sub patterns according to a random seed for each pixel group, and the mask generation unit 230 generates a mask, in which gray data are inserted into the pixel corresponding to the number of (M*L)/4, for each frame according to the decided main pattern and sub patterns.

Referring to again FIG. 3, the mask generation unit 230 transfers the generated mask to the masking unit 240.

The masking unit 240 masks grayscale data of RGB data of an image frame to be originally output using the mask received from the mask generation unit 230. The masking unit 240 generates grayscale data by compensating the grayscale data of the image frame to be originally output by gray data, and transfers the grayscale data to the data driving unit 310.

By doing so, the stress on a liquid crystal may be reduced, and thus a residual image may be prevented from occurring on a screen. Accordingly, a user may easily watch a screen without a residual image.

Figure 8:
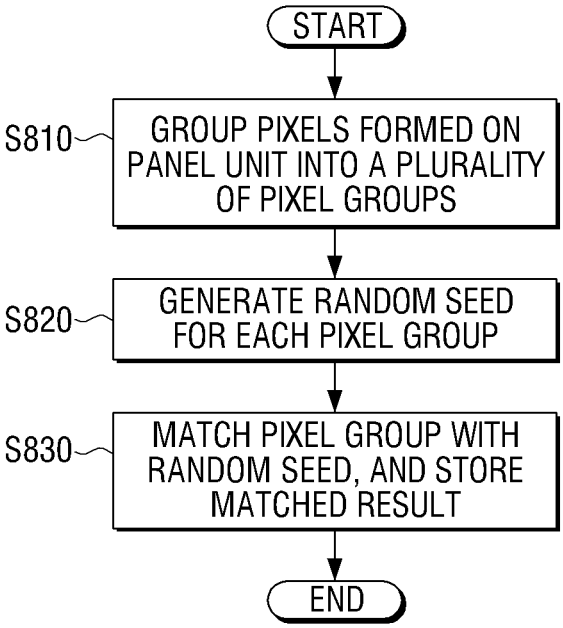
FIG. 8 is a view provided to explain a method for deciding a random seed according to an exemplary embodiment.

FIG. 8 is a view provided to explain a method for deciding a random seed according to an exemplary embodiment.

The LCD apparatus groups pixels formed on the panel unit 100 into a plurality of pixel groups (S810). The LCD apparatus generates a random seed for each pixel group (S820). The random seed may be automatically generated after the pixels are grouped, or may be pre-stored before the pixels are grouped.

The LCD apparatus may match a pixel group with the random seed generated for each pixel group, and store the matched result (S830).

The random seed may be decided on or before frame 0 which is the first frame of image frames starts.

Figure 9:
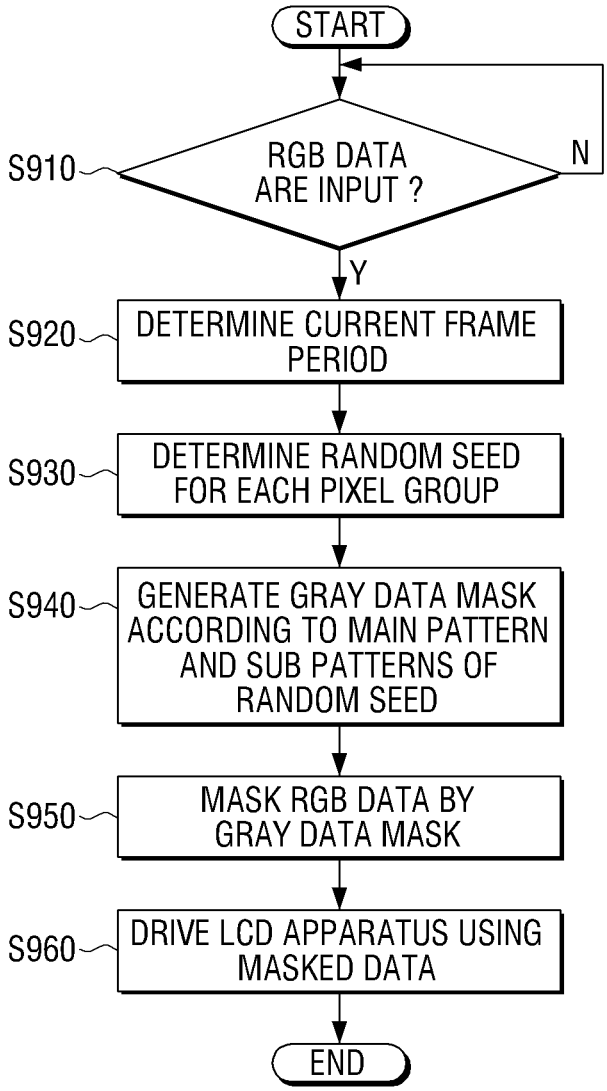
FIG. 9 is a view provided to explain a method for driving an LCD apparatus according to an exemplary embodiment.

FIG. 9 is a view provided to explain a method for driving an LCD apparatus according to an exemplary embodiment.

The LCD apparatus receives RGB data in a frame unit (S910). The LCD apparatus determines a current frame period using the RGB data being input in a frame unit (S920), and determines a random seed being stored for each pixel group (S930).

The random seed may be generated and stored after the current frame period is determined.

The LCD apparatus generates a grayscale mask for RGB data being input according to a main pattern and sub patterns of a random seed (S940), and masks RGB data by the generated grayscale mask (S950).

The LCD apparatus is driven using the RGB data which are masked by gray data (S960).

The method for deciding a random seed and the method for driving an LCD apparatus may prevent a residual image from occurring on a screen by reducing the stress on a liquid crystal.

As described above, the main pattern and the sub patterns may be applied differently for each pixel group, and it is not necessary for all of the pixels formed on the panel unit 100 to have the same main pattern or the same sub patterns. Additionally, gray data may be inserted into pixels according to a specific main pattern or sub patterns for each pixel group.

Figure 10:
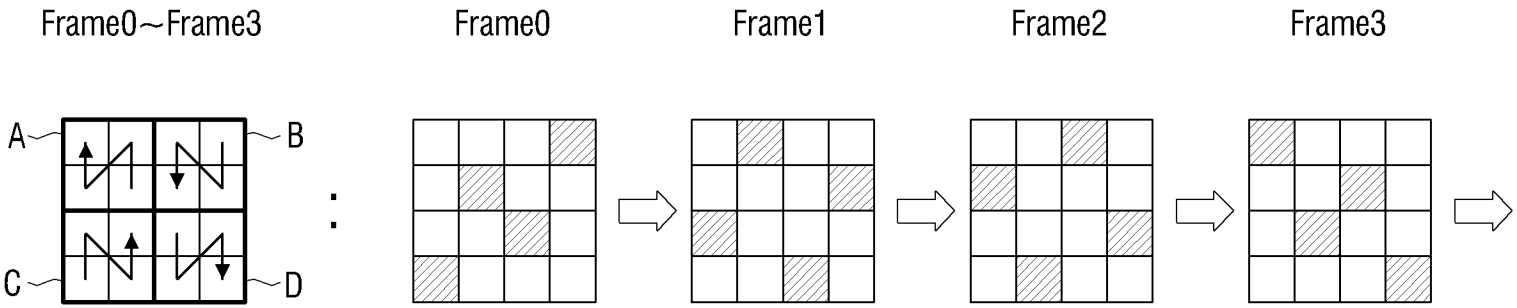
FIG. 10 is a view illustrating pixel groups in which a main pattern and sub patterns are applied differently for each pixel group.

FIG. 10 is a view in which a main pattern and sub patterns are applied differently for each pixel group. FIG. 10 illustrates a pattern which efficiently achieves the reduction of the stress on a liquid crystal and the prevention of a residual image on a screen when there are four of 2*2 pixel groups.

As shown in FIG. 10, four 2*2 pixel groups are formed on an upper-left pixel group A, an upper-right pixel group B, a lower-left pixel group C, and a lower-right pixel group D. Gray data are inserted into pixels included in the upper-left pixel group A from frame 0 to frame 3 in order of a lower-right pixel, an upper-right pixel, a lower-left pixel, and an upper-left pixel. Gray data are inserted into pixels included in the upper-right pixel group B from frame 0 to frame 3 in order of an upper-right pixel, a lower-right pixel, an upper-left pixel, and a lower-left pixel. In addition, gray data are inserted into pixels included in the lower-left pixel group C from frame 0 to frame 3 in order of a lower-left pixel, an upper-left pixel, a lower-right pixel, and an upper-right pixel. Gray data are inserted into pixels included in the lower-right pixel group D from frame 0 to frame 3 in order of an upper-left pixel, a lower-left pixel, an upper-right pixel, and a lower-right pixel.

If a main pattern and sub patterns are applied differently for each pixel group as shown in FIG. 10, the reduction of stress on a liquid crystal and the prevention of a residual image on a screen may be efficiently achieved.

In this exemplary embodiment, gray data are inserted into part of a screen according to a main pattern and sub patterns, not all of a screen.

Figure 11:
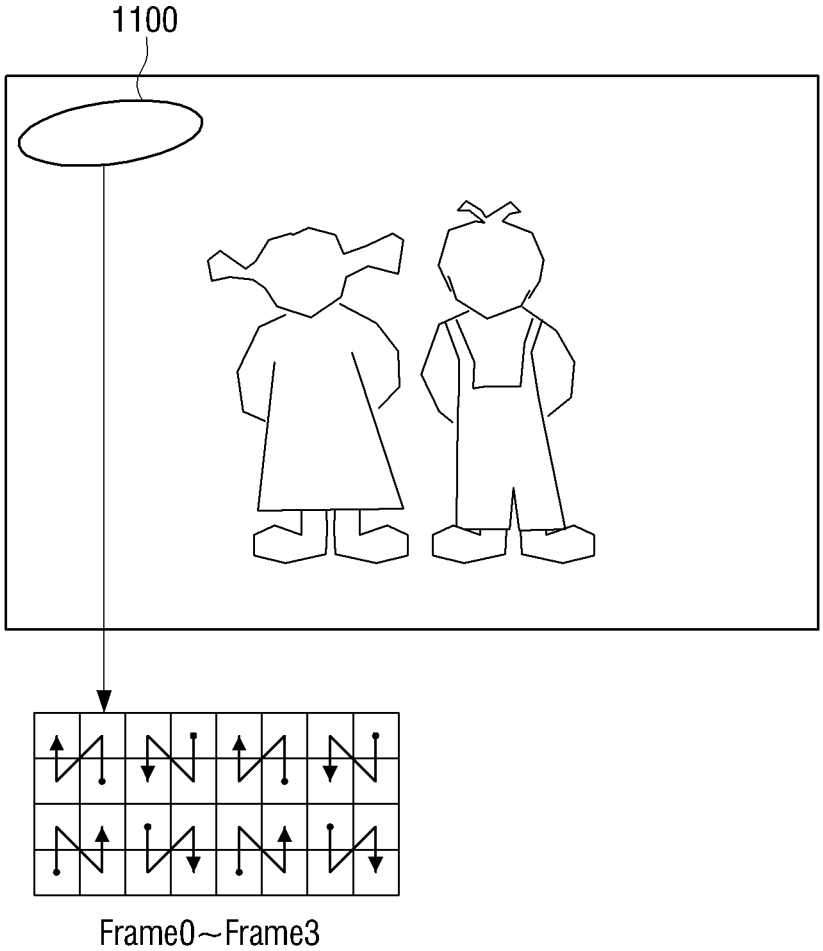
FIG. 11 is a view illustrating a screen, in which gray data are inserted into part of a screen according to a main pattern and sub patterns.

FIG. 11 is a view illustrating a screen, in which gray data are inserted into only part of a screen according to a main pattern and sub patterns. The case of inserting gray data into only part of a screen is employed when the same image is fixedly and continuously displayed on a specific part of a screen, like a logo or a trademark of an advertisement. As shown in FIG. 11, if an image next to a trademark 1100 is changed while the trademark 1100 is fixedly and continuously displayed on an upper-left portion of a screen, gray data are inserted into only pixels corresponding to the trademark 1100 and are not inserted into the other pixels.

Accordingly, the stress on a liquid crystal is efficiently reduced, and a residual image is effectively prevented from occurring on a screen.

Moreover, a residual image is prevented from occurring on a screen as the stress on a liquid crystal is reduced, and thus a user may watch a screen without inconvenience, and an image provider may decrease the cost of replacing a panel, due to the residual image.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A liquid crystal display (LCD) apparatus comprising:

a panel unit which comprises at least one pixel group comprising a plurality of pixels; and a controlling unit which inserts gray data which is not image data into at least one pixel of the plurality of pixels of the at least one pixel group and inserts image data into the other pixels of the plurality of pixels of the at least one pixel group according to a frame period and a polarity of the plurality of pixels, wherein:

the controlling unit inserts gray data into at least one pixel of a first pixel group in a first pattern and inserts gray data in at least one pixel of a second pixel group in a second pattern different from the first pattern, in a first frame period, the controlling unit inserts gray data into the at least one pixel of the first pixel group according to a first sub pattern of the first pattern, and inserts gray data into the at least one pixel of the second pixel group according to a first sub pattern of the second pattern, and in a second frame period, the controlling unit inserts gray data into the at least one pixel of the first pixel group according to a second sub pattern of the first pattern which is different from the first sub pattern of the first pattern, and inserts gray data into the at least one pixel of the second pixel group according to a second sub pattern of the second pattern which is different from the first sub pattern of the second pattern.

2. The LCD apparatus as claimed in claim 1, wherein the controlling unit inserts the gray data into the at least one pixel of the at least one pixel group in a predetermined pattern for a predetermined frame period.

3. The LCD apparatus as claimed in claim 2, wherein the predetermined pattern is a pattern in which gray data is inserted into the at least one pixel of the plurality of pixels of the at least one pixel group for a single frame.

4. The LCD apparatus as claimed in claim 2, wherein the predetermined pattern is a pattern in which the gray data is inserted into each pixel of the plurality of pixels of the at least one pixel group at least one time for the predetermined frame period.

5. The LCD apparatus as claimed in claim 2, wherein the controlling unit selects one predetermined pattern of a plurality of predetermined patterns for each pixel group of the at least one pixel group, and inserts the gray data according to the selected pattern.

6. The LCD apparatus as claimed in claim 2, wherein the predetermined pattern comprises a plurality of sub patterns, and the controlling unit inserts gray data into the at least one pixel of the plurality of pixels of the at least one pixel group according to a first sub pattern in a first frame period, and inserts gray data into the at least one pixel of the plurality of pixels of the at least one pixel group according to a second sub pattern in a second frame period.

7. The LCD apparatus as claimed in claim 6, wherein in the first sub pattern, the controlling unit inserts gray data into each pixel of the plurality of pixels of the at least one pixel group beginning with a first pixel and ending with a last pixel, including inserting gray data into a second pixel after the first pixel; and wherein, in the second sub pattern, the controlling unit inserts gray data into each pixel of the plurality of pixels of the at least one pixel group beginning with the second pixel and ending with the first pixel.

8. The LCD apparatus as claimed in claim 6, wherein the second sub pattern is rotated at least one pixel in relation to the first sub pattern.

9. The LCD apparatus as claimed in claim 1, wherein if the at least one pixel group is formed by N*N pixels, the controlling unit inserts the gray data into each pixel of the plurality of pixels of the at least one pixel group every $(N^2-1)_{th}$ frame or $(N^2+1)_{th}$ frame.

10. The LCD apparatus as claimed in claim 1, wherein the controlling unit inserts gray data into a first pixel of the plurality of pixels of the at least one pixel group during a first frame;

determines a time point after the first frame at which a number of frames during which the first pixel has positive polarity is identical to a number of frames during which the first pixel has negative polarity; and inserts gray data into the first pixel at the determined time point.

11. The LCD apparatus as claimed in claim 1, further comprising:

an input unit which receives Red, Green, Blue (RGB) data, wherein the controlling unit generates a gray data mask based on information regarding the at least one pixel of the plurality of pixels of the at least one pixel group into which gray data are inserted in a current frame, and masks the RGB data using the gray data mask.

12. The LCD apparatus as claimed in claim 11, further comprising:

a driving unit which generates gray data voltage and normal data voltage, and inserts one of the gray data voltage and the normal data voltage into the plurality of pixels of the at least one pixel group, wherein the controlling unit controls the driving unit based on the RGB data masked by the gray data mask to apply one of the gray data voltage and the normal data voltage to each pixel of the plurality of pixels of the at least one pixel group.

13. A liquid crystal driving apparatus, comprising:

a gate driving unit which applies gate-on voltage to a plurality of pixels; and a data driving unit which applies gray data voltage corresponding to gray data which is not image data to at least one pixel of the plurality of pixels and applies normal data voltage corresponding to image data to the other pixels of the plurality of pixels according to a frame period and a polarity of the plurality of pixels, wherein:

the data driving unit applies gray data voltage to at least one pixel of a first pixel group in a first pattern and applies gray data voltage to at least one pixel of a second pixel group in a second pattern different from the first pattern, in a first frame period, the data driving unit applies gray data voltage to the at least one pixel of the first pixel group according to a first sub pattern of the first pattern, and applies the gray data voltage to the at least one pixel of the second pixel group according to a first sub pattern of the second pattern, and in a second frame period, the data driving unit applies gray data voltage to the at least one pixel of the first pixel group according to a second sub pattern of the first pattern which is different from the first sub pattern of the first pattern, and applies gray data voltage to the at least one pixel of the second pixel group according to a second sub pattern of the second pattern which is different from the first sub pattern of the second pattern.

* * * * *